United States Patent [19]

Oksman

[11] Patent Number: 4,563,967

[45] Date of Patent: Jan. 14, 1986

[54] SPORT SAILBOAT STEERING AND BALANCING ARRANGEMENT

[76] Inventor: G. Timothy Oksman, 15 N. 29th St., Richmond, Va. 23223

[21] Appl. No.: 665,517

[22] PCT Filed: Feb. 26, 1982

[86] PCT No.: PCT/US82/00252

§ 371 Date: Sep. 29, 1982

§ 102(e) Date: Sep. 29, 1982

[87] PCT Pub. No.: WO83/02927

PCT Pub. Date: Sep. 1, 1983

Related U.S. Application Data

[63] Continuation of Ser. No. 428,489, Sep. 29, 1982, abandoned.

[51] Int. Cl.[4] ..... B63B 35/00

[52] U.S. Cl. ..... 114/39; 114/144 R

[58] Field of Search ..... 114/39, 102, 103, 123, 114/144 R, 162, 163

[56] References Cited

U.S. PATENT DOCUMENTS

| | | | |
|---|---|---|---|
| 1,785,971 | 12/1930 | O'Connor | 114/162 |
| 3,931,776 | 1/1976 | Kreuger | 114/39 |
| 3,985,090 | 10/1976 | Rineman | 114/39 |
| 4,054,100 | 10/1977 | Rineman | 114/102 |

FOREIGN PATENT DOCUMENTS

| | | | |
|---|---|---|---|
| 2480702 | 10/1981 | France | 114/102 |

*Primary Examiner*—Galen L. Barefoot
*Assistant Examiner*—Jesûs D. Sotelo
*Attorney, Agent, or Firm*—W. Brown Morton, Jr.

[57] ABSTRACT

A monohull, sport, sailing boat with fixed mast, centerboard, and rudder, cat-rigged with righting moment provided by manipulation of a trapeze attached high on the mast by a support line of adjustable length. Steering lines running forward from a thwartship steering bar affixed to the rudder lead to a slide car carried on a thwartship track forward of the mast. The tiller is connected to this car by a universal joint. The mainsheet is led forward of the mast and its forward location with the tiller and trapeze permit the sailor to cross in front of the mast when tacking without having to release the tiller or the sheet or to change trapeze adjustment. This arrangement also permits use of a larger said area.

9 Claims, 8 Drawing Figures

SPORT SAILBOAT STEERING AND BALANCING ARRANGEMENT

This is a continuation of Ser. No. 428,489, filed Sept. 29, 1982, now abandoned.

TECHNICAL FIELD

The technical field of this invention is that of small sport sailboats, especially those usually sailed by one person, with or without one or two companions. Frequently the occupants of such boats wear wet suits or bathing suits and the operator expects to expend substantial physical energy and to be called upon to display substantial skill and ready agility to get the fastest and most exhilarating performance from the boat.

BACKGROUND ART

There are two principal sorts of boats in common use today for which a boat arranged according to my invention is a competitive replacement combining many of the virtues of each. One sort is exemplified by the well-known "Windsurfer ®" in which the sail is mounted on the hull by a universal joint and the sail is extended by a wishbone boom. The operator stands on top of the hull and controls the balance, speed, and direction of the boat by manipulating the angle of the mast to the hull and the alignment of the wishbone by his hands. An outrigger variant of this sort of boat is shown in U.S. Pat. No. 3,985,900. The other sort generally has a shallow, decked-over hull (referred to in the trade as a "board boat") rigged with a fixed mast, a spar-supported sail conventionally sheeted, and steered from a position abaft the mast, and on which the sailor moves under the boom, aft of the mast, when tacking.

Two interesting variants were considered during the preparation of this application. One variant is U.S. Pat. No. 3,902,442 which discloses a sailboat having two rudders, one at each opposite end A and B, that is worked to windward not by coming about but by reversing the direction of motion from A end first to B end first by manipulation of the sails and stays. The rudder at the end that is the "stern" from time to time affords the steering; the rudder at the other end is locked to provide a sort of centerboard. The other variant is U.S. Pat. No. 3,931,779. It shows a sport cat boat with a conventional rudder aft controlled by a tiller turning in a horizontal plane about a vertical pivot in the foredeck. A second rudder is provided connected to the after end of the mainsail boom. Various arrangements are shown for controlling this novel auxiliary rudder to make the boom-to-keel-line angle automatically variable in response to wind pressure. A conventional trapeze and harness abaft the mast is shown.

DISCLOSURE OF INVENTION

The arrangement of this invention relates to sailing boats, typically small, recreational catboats with a hull, a fixed mast, a centerboard, a rudder, and a mainsail. It uniquely combines a tiller attached to the hull by a universal joint, preferably on a slide track forward of the mast, and the use of a trapeze attached high on the mast by a single support line to be manipulated by the sailor also forward of the mast. The mainsheet also runs to the control station forward of the mast. The righting moment is provided by the use of a trapeze mounted high on the mast to swing freely from side to side across in front of the mast rather than by the use of hiking straps. The placement of the tiller and mainsheet allows tacking by easily changing sides in front of the mast without unhitching the trapeze harness. Because this invention utilizes the basic sailing boat features, the complex process involved in using the windsurfer example, mounting the mast on a universal joint and changing the center of effort, is eliminated. The trapeze reduces the physical strength necessary to operate the type of vessel exemplified by the "Windsurfer ®". The purpose of this invention is to provide the advantages of a trapeze on a small, single-handed sailboat. Absent an ability to tack by moving in front of the mast, a trapeze is impractical on a one-man sailboat. The trapeze provides additional righting moment, which, for the first time, will allow a small boat to carry a larger sail for increased speed and better performance and will require less physical exertion. An additional advantage of the trapeze is in providing stability to the mast in strong winds analogous to that provided by a conventional shroud thereby permitting construction of the boat in light-weight materials. The forward placement of the tiller affords the sailor the advantage of tacking by crossing the boat forward of the mast without dodging the boom. Forward placement of the mainsheet is another necessary element to permit tacking in front of the mast.

The mainsail may be rigged with a sleeve luff and may be loose-footed, although these features are not elements of the invention. The invention requires no standing rigging. Its running rigging is simple and includes a mainsheet, a clew outhaul, a trapeze length adjuster, and a vang. The centerboard and rudder may be built to kick-up so that the boat can be sailed directly onto a beach without damage.

The tiller preferably connects by a universal joint to a slide car running on a track affixed to the deck forward of the mast. This slide car is connected to the rudder by a system of lines and a lateral steering bar on the rudder. Alternatively, the tiller can be connected to the deck without the track and car by a stainless steel coil spring (or other connector) affording motion equivalent to a universal joint and maintained generally perpendicular to the plane of the deck when the rudder is centered. In either preferred or alternative arrangement the universal motion accords the sailor increased versatility in operating the tiller in comparison with a conventional tiller movable in a fixed plane about an axis which is essentially perpendicular to the keel.

BRIEF DESCRIPTION OF DRAWINGS

The invention will be described in detail with reference to the accompanying technical drawings in which.

BEST MODE FOR CARRYING OUT THE INVENTION

Figure 1:
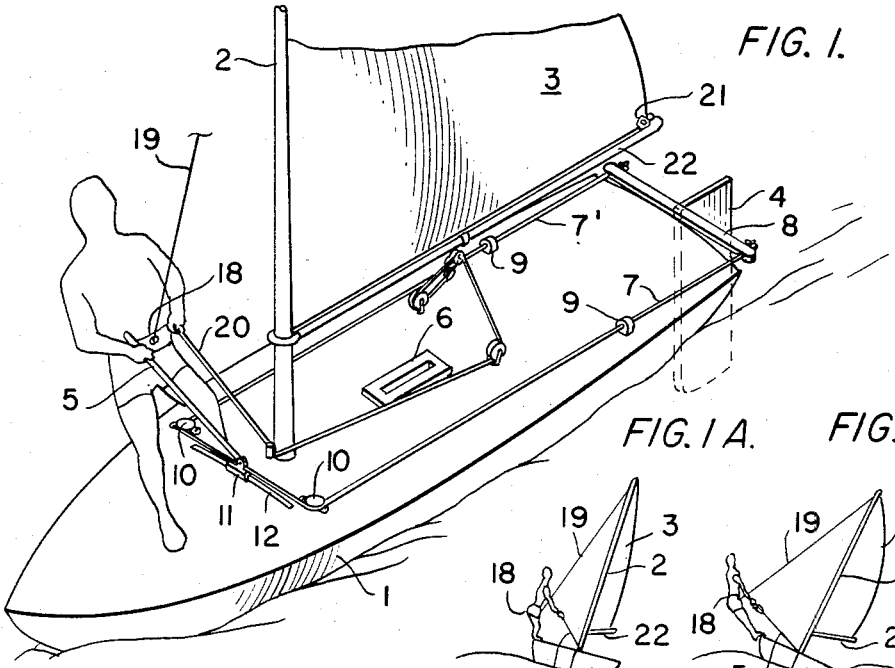
FIG. 1 is a perspective view of the preferred car-and-track embodiment of a boat arranged according to the invention.
Figure 1A:
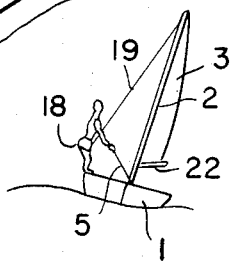
FIGS. 1A and 1B illustrate diagrammatically operation of the boat in light and heavy air, respectively.
Figure 1B:
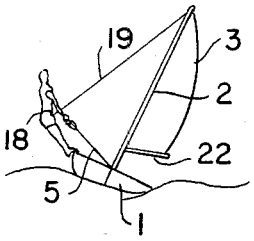

Generally, the invention provides a small, one-man, high-performance board boat. The specific boat pictured in FIG. 1 comprises a hull 1, a fixed mast 2, a catmainsail 3, and a rudder 4. The sail 3 is conveniently attached to the mast 2 through a sleeve luff and may be loose-footed. The hull is readily provided with both the fore and after decks adaptable for sunbathing. The foredeck is flared to prevent submarining. A tiller 5 is located forward of the mast. The rudder 4 and the centerboard (not shown), for example mounted through well 6, may be made "kick-up" to prevent damage when beaching.

The top of the rudder 4 has a steering bar 8 fastened to it running athwart the boat. The port and starboard steering lines 7 and 7' are snapped to either side of the steering bar 8 laterally displaced from the rudder pivot to provide lever arms. Lines 7 and 7' run forward through fair leads 9 and cheek blocks 10 to connect with the tiller slide car 11.

Slide car 11 is mounted forward of the mast 2 on a track 12 that runs athwartships affixed to the deck. The tiller 5 is connected to the car 11 by a universal joint.

Figure 2:
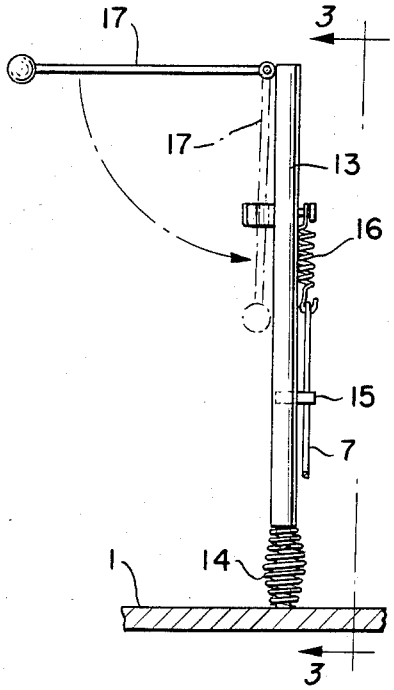
FIGS. 2 and 3 are front and rear elevations, respectively, of a tiller according to the invention employing the alternative coil spring mounting.
Figure 3:
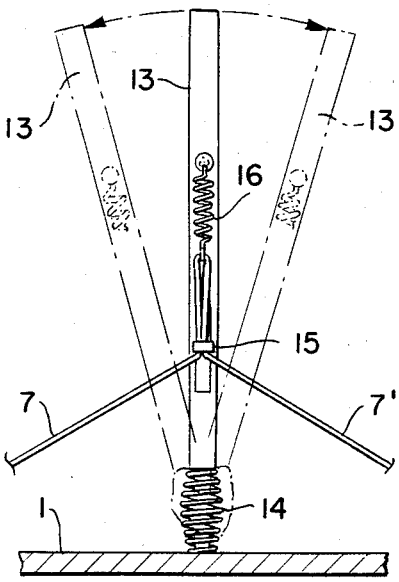
Figure 4:
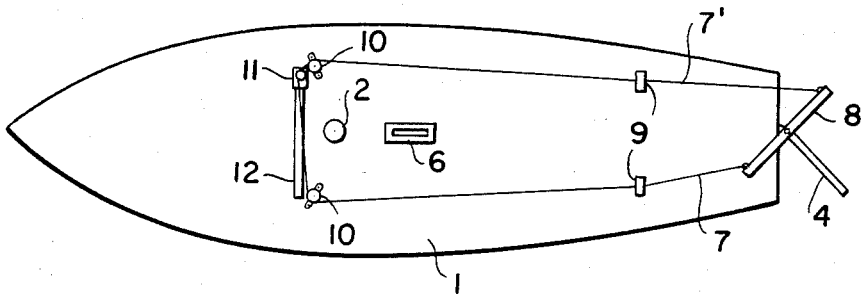
FIGS. 4, 5, and 6 are plan views showing the movement of the tiller and rudder in the car-and-track embodiment.
Figure 5:
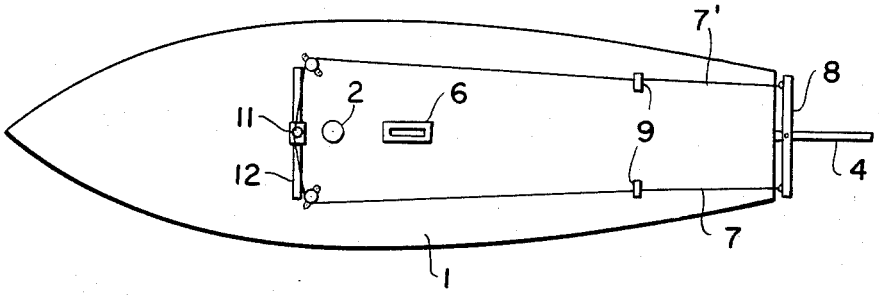
Figure 6:
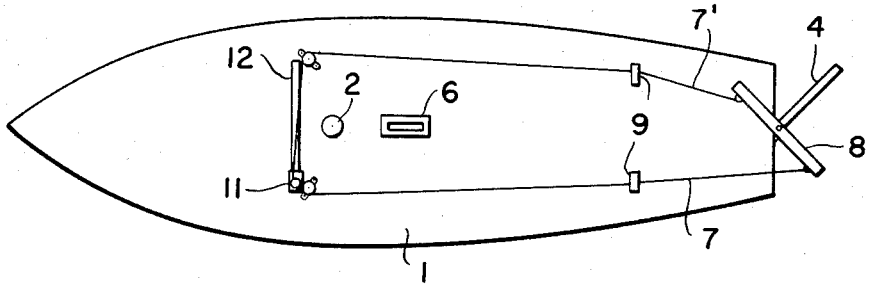

The sailor controls the rudder 4 by manipulating tiller 5 to move car 11 from side to side along on track 12. As car 11 moves to port, the port line 7 is slacked and the starboard line 7 is pulled, causing the rudder to swing to starboard. The reverse occurs on moving the tiller car to starboard. The transverse bar 8 on the rudder 4 prevents the rudder from being pinned sideways against the boat's transom, for it gives sufficient leverage to return rudder 4 to a centered position from a position of maximum deflection. The universal joint between tiller 12 and car 11 permits the sailor to move fore and aft on the boat in order to maintain the best trim of hull 1. The slide track permits manipulation of port and starboard lines 7,7' with minimum play and the virtues of strength and simplicity. The coil spring alternative of FIGS. 2 and 3 comprises a tiller-stick 13 mounted forward of mast 2 on the deck of hull 1 by a coil spring 14 which holds it vertical unless moved by the sailor. Lines 7,7' are led from cheek blocks 10 through guide 15 on the back of stick 13 to a tensioning spring 16 carried by the into during tacking and no boom to duck. The usual small boat "contortions" are thus avoided and a graceful, virtually effortless swing across the deck is made possible. The forward location of the tiller and mainsheet control station permits the tacking maneuver to be accomplished without any release of the tiller or sheet, thus preventing a momentary loss of control, and without unhitching and rehitching the trapeze. A trapeze arranged according to the invention is of material assistance in righting the boat in event of a capsize.

It will be apparent to the skilled small boat designer that many refinements in the placing of the rigging and hardware could be made, for example, running the lines 7,7' in grooves or under the deck to leave the after deck unencumbered, but these details do not form a part of this invention which is defined in the claims.

I claim:

1. In a sport sailboat of the type including a hull, a fixed mast, a boom pivotally mounted at its forward end to the mast, a mainsail attached to the mast and boom, a mainsheet for controlling the angle of the boom with respect to the fore-and-aft center line of the hull, and a stern-mounted rudder, the improvement comprising mounting the mast sufficiently far aft to provide a control station forward of the mast spacious enough to accommodate at least one standing and actively controlling sailor; a vertically standing tiller at said control station operably connected to joint means at its base for permitting tilting of said tiller relative to a vertically standing position, wherein tilting of said tiller actuates said rudder; steering lines operably connecting the rudder to the tiller, rigging for said mainsheet to be controllable by a sailor at the control station, and a trapeze harness usable by a sailor at the control station to provide righting moment on either tack, the harness being attached high up on the mast by a support line rigged to pass freely from port to starboard and back forward of the mast.

2. A boat as in claim 1 in which a transverse steering bar is affixed to the rudder and connected to said steerrigged to be controllable from the control station, a trapeze harness at the control station attached high up on the mast by a support line, a universal joint connecting the tiller to the deck, and spring-biassed means arranged to maintain the tiller normally vertical, the steering lines being arranged to lead to the rudder assembly from a point on the tiller a substantial distance above the deck, whereby the tiller may cause the lines to adjust the rudder.

8. A boat as in claim 7 in which the steering lines pass up through an eye on the tiller at the point of their connection leading to the rudder assembly and are secured to the tiller through a slack-controlling spring tensioner.

9. A boat as in claim 7 in which a tiller extension, pivotable in a vertical plane is attached to the tiller near the top thereof.

* * * * *